US005478703A

United States Patent [19]

Simons

[11] Patent Number: 5,478,703

[45] Date of Patent: Dec. 26, 1995

[54] METHOD AND MATERIAL FOR PHOTOGRAPHIC PROCESSING

[75] Inventor: Michael J. Simons, Middx, United Kingdom

[73] Assignee: Eastman Kodak Company, Rochester, N.Y.

[21] Appl. No.: 330,109

[22] Filed: Oct. 27, 1994

Related U.S. Application Data

[63] Continuation of Ser. No. 107,657, filed as PCT/EP92/02916, Dec. 16, 1992, abandoned.

[30] Foreign Application Priority Data

Dec. 18, 1991 [GB] United Kingdom ..... 9126852

[51] Int. Cl.[6] ..... G03C 7/42

[52] U.S. Cl. ..... 430/383; 430/393; 430/404; 430/456; 430/458

[58] Field of Search ..... 430/202, 231, 430/383, 393, 404, 429, 456, 458

[56] References Cited

U.S. PATENT DOCUMENTS

| | | | |
|---|---|---|---|
| 2,665,986 | 1/1954 | Rott | 430/238 |
| 3,516,827 | 6/1970 | Schreck et al. | 430/206 |
| 3,721,562 | 3/1973 | Land | 430/404 |
| 3,982,946 | 9/1976 | Maekawa et al. | 430/225 |
| 4,775,614 | 10/1988 | De Rycke | 430/429 |
| 4,830,949 | 5/1989 | De Rycke | 430/206 |
| 4,948,711 | 8/1990 | Kojima et al. | 430/393 |

FOREIGN PATENT DOCUMENTS

| | | |
|---|---|---|
| 0290077 | 11/1988 | European Pat. Off. . |
| 2123376 | 9/1972 | France . |
| 22602124 | 8/1975 | France . |

*Primary Examiner*—Hoa Van Le
*Attorney, Agent, or Firm*—J. Lanny Tucker; Sarah Meeks Roberts; Lee J. Fleckenstein

[57] ABSTRACT

A method of fixing a developed photographic silver halide material comprising at least 2 silver halide layers sensitized to different regions of the spectrum, comprising placing the material in face-to-face contact with a fixer sheet in the presence of a processing solution and a silver halide solvent which forms a solubilized silver halide species from the undeveloped areas of the material, wherein the fixer sheet contains reducing means capable of forming metallic silver therein from the solubilized silver halide.

10 Claims, No Drawings

METHOD AND MATERIAL FOR PHOTOGRAPHIC PROCESSING

This application is a continuation of application Ser. No. 08/107,657, filed as PCT/EP92/02916, Dec. 16, 1992, now abandoned.

This invention relates to photographic processing and, in particular to a method of fixing employing a fixer sheet laminatable-to the photographic material to be processed.

In conventional photographic processing it is usual to form an image by developing an imagewise exposed silver halide photographic material and then removing the unexposed (and undeveloped) silver halide with a fixer solution. The fixer solution contains a silver halide solvent, typically an alkali metal or ammonium thiosulphate, which forms soluble complexes with the silver halide which then pass into the solution thus leaving the photographic material substantially free of silver halide.

The silver salt diffusion transfer process is also well known and provides a black-and-white image by placing an imagewise exposed silver halide material in face-to-face contact with a receiving layer in the presence of a silver halide solvent, a silver halide developing agent and silver precipitating nuclei. In the initial developing phase, a silver image is developed in the silver halide material while, in a second phase, undeveloped silver halide is transported as a soluble complex with the silver halide solvent to the receiving layer where metallic silver is deposited adjacent to the silver precipitating nuclei having been formed by reduction of the solubilised silver halide by developing agent.

In a variation of the above processes it is known to process black-and-white photographic materials by placing them in face-to-face contact with a receiver sheet in the presence of a developing agent and a silver halide solvent. A recent example of such a process is described in U.S. Pat. No. 4,775,614 in which receiver sheets comprise a water-absorbing polymer layer, silver precipitating nuclei and a silver halide solvent.

U.S. Pat. No. 3,179,517 describes a method of fixing black-and-white materials by lamination to a receptor element wherein, inter alia, zinc sulphide is used as a silver ion precipitating agent. The precipitation reaction in this case being a conversion reaction (metathesis). In this reaction the silver halide is converted to silver sulphide and the zinc sulphide to zinc halide.

Colour or dye diffusion transfer systems are also known wherein a dye migrates to a receiver sheet and forms a colour image therein. The dyes are formed from a class of compounds specially designed to do this in response to silver halide development and examples of such compounds are the dye developers and redox dye releasers described for use in instant photographic products.

U.S. Pat. No. 4,480,025 describes the bleaching and fixing of a developed colour silver halide photographic material by using a bleach-fix sheet comprising a water-supplying layer, a bleaching agent, a silver halide solvent and a dye mordant. The particular use exemplified is to bleach and fix a colour diffusion transfer material so that the retained image is usable. This system operates at an acid pH and contains an oxidising agent to achieve the bleaching of silver.

Applying the concept of fixing by lamination to a camera speed film material, presents special problems. Due to the practice of using high silver halide levels coupled with partial development of the grains (a technique employed to achieve the best granularity) there are high levels of silver halide to remove. This leads to incomplete removal of silver halide when using previously suggested systems.

According to the present invention there is provided a method of fixing a developed photographic silver halide material comprising at least 2 silver halide layers sensitised to different regions of the spectrum, comprising placing the material in face-to-face contact with a fixer sheet in the presence of a processing solution and a silver halide solvent which forms a solubilised silver halide species from the undeveloped areas of the material, wherein the fixer sheet contains reducing means capable of forming metallic silver therein from the solubilised silver halide.

The reducing means may comprises a reducing agent incorporated in the fixer sheet and it is preferably ballasted to render it immobile. Examples of such reducing agents include ascorbyl palmitate and ballasted hydroquinones, for example, 2,5-dioctylhydroquinone.

In another embodiment of the present invention the reducing means comprises a metal more electropositive than silver. The metal may be, for example, magnesium, zinc or, preferably, aluminium. Such a metal may be incorporated in a layer of the fixer sheet as particles or flakes.

The presence of the reducing means removes solubilised silver halide from the processing solution and drives the reaction in the desired direction. During the process, silver halide in the image sheet is dissolved by the silver halide solvent, diffuses into the vicinity of the reducing means in the receiver sheet, and is reduced to metallic silver. This releases the silver halide solvent, which can diffuse back into the image sheet to repeat the cycle. In the limit, most of the silver halide in the image sheet can end up as silver metal in the receiver sheet.

The advantages of the invention include the provision of a means of fixing a photographic film or other material which avoids the need for a separate fixing bath with its associated difficulties of silver recovery or disposal when exhausted. The process can also operate with lower levels of silver halide solvent than conventional fixing baths, and can result in less escape of fixing agent into the environment. The fixer sheet can also conveniently be sent away for recovery and recycling of the silver. An important further advantage of the invention over conventional fixing baths is that it allows products of photographic colour processing to be trapped in the receiver sheet and therefore not discharged into the environment. This is particularly valuable for smaller scale photofinishing operations where full-scale pollution control equipment to treat their effluent would be too costly and inconvenient.

The use of a metal more electropositive than silver has a further significant advantage in that much less material need be coated. Ballasted organic reducing agents have molecular weights in the region of 400, and are capable of reducing two silver ions per molecule of reducing agent, giving a "reduction equivalent weight" of about 200. Aluminium has an atomic weight of 27, and one atom can reduce three silver ions, giving a "reduction equivalent weight" of just 9. So the mass of material which need be coated is greatly reduced. Further, it is thought that a coated layer of aluminium flakes may be less susceptible to oxidation on keeping than many organic reducing agents.

The solution may, if desired, be rendered alkaline by the presence of a base, for example sodium carbonate. A preferred base, however, is an amino acid salt, for example, the sodium salt of glycine.

The fixer sheet may contain coated layers comprising a water-permeable binder, for example, gelatin or a gelatin derivative. Such layers will contain the reducing means for forming the metallic silver and, if desired, an electron transfer agent.

The fixer sheet may also contain silver precipitating nuclei and these are well known and may for example be nickel sulphide, silver sulphide or silver particles.

The fixer sheet may comprise a coated layer or layers on a photographic support, eg paper, resin coated paper or film base. Such supports are referred to in Research Disclosure Item 308119, December 1989 published by Kenneth Mason Publications, Emsworth, Hants, United Kingdom.

The fixing reaction may be carried out in the presence of an electron transfer agent (ETA) which may be dissolved in the processing solution or incorporated into the film or fixer sheet. Such an ETA may be a pyrazolidinone, for example, 4 -hydroxymethyl-4-methyl-1-pheny-3-pyrazolidone (MOP).

In further embodiments of the invention, the fixer or receiver layer may contain substances which can react with and immobilise or render harmless colour developing agents, oxidised colour developing agents, and bleaching agents. For example an agent such as a coupler, which can react with oxidised colour developing agent to form a harmless immobile substance in the receiver layer, may also be coated in the receiver layer to react with unreacted colour developing agent and prevent its release to the environment.

The silver halide solvent, such as sodium thiosulphate, which is necessary for the process, may be coated in whole or part in the fixing or receiving sheet, possibly beneath a hydrolysable timing layer or within microcapsules, to give a timed release. The fixing step may be carried out after separate development and bleaching steps, or after a separate development step but without bleaching (the unwanted density from the silver metal image being corrected for by suitable means), or a no-bleach process may be run using a single solution containing colour developing agent, alkali or base, and a silver halide solvent, to give a single stage soak-and-laminate process which gives a developed and fixed image on separating the two sheets.

For the single stage process, the fixer sheet may contain a developing agent layer intended to develop the silver halide material before the fixing process begins. To achieve this the developing agent would be coated in a layer furthest from the support and be temporarily isolated from the other layers by a timing layer which breaks down after a time delay thus enabling the development reaction to proceed before the fixing begins. Timing layers are known especially from the diffusion transfer art.

The photographic materials to be processed may be black-and-white or, more usually, colour materials. Such colour materials may be multilayer materials and may contain one or more colour couplers.

The colour materials to be processed may be any of those described in Research Disclosure Item 308119, December 1989 published by Kenneth Mason Publications, Emsworth, Hants, United Kingdom, while the fixer sheets may be coated on a support and contain materials used in photography and described in said Research Disclosure.

Typical colour materials are those comprising a support bearing a yellow dye image-forming unit comprised of at least one blue-sensitive silver halide emulsion layer having associated therewith at least one yellow dye-forming coupler, at least one magenta dye image-forming unit comprising at least one green-sensitive silver halide emulsion layer having associated therewith at least one magenta dye-forming coupler at least one cyan dye image-forming unit comprising at least one red-sensitive silver halide emulsion layer having associated therewith at least one cyan dye-forming coupler.

Alternatively the colour material may be one designed for a process in which at least some colour information is gained by means other than the colour of a dye image. Some materials of this type are described in our copending application number 9115620.8 (docket 61626). The image information in this case is obtained by a scanning process followed by analysis and processing of the electronic signals obtained.

In the Examples, a p-phenylene diamine developing agent is used, but the fixer sheet of the invention may be used in conjunction with a wide range of developing agents or colour imaging chemistries, including colour image transfer types of chemistry.

The following Examples are included for a better understanding of the invention.

EXAMPLE 1

A colour negative film having red, green and blue sensitive emulsion layers containing respectively cyan, magenta and yellow dye forming couplers was used. The different colour recording layers were separated by interlayers, the interlayer between the blue- and green-sensitised layers containing a dispersion of yellow filter dye whose colour was dischargeable in basic solutions. The light-sensitive silver bromoiodide photographic emulsions were of the tabular grain type, and contained between 3% and 6% of the halide as iodide. Mean grain projected areas were between 0.1 and 1.7 square micrometers, and mean grain thickness between 0.08 and 0.14 micrometers. Silver laydowns were 1.95, 1.25 and 0.4 g/m$^2$ in the red, green and blue sensitive layers respectively. The film was coated on cellulose triacetate film base having a carbon-containing antihalation layer on its back surface, and this layer being removable before or during processing.

A fixer or receiver coating was prepared by coating the following layers in order on cellulose triacetate photographic film base:

| Layer 1 | |
|---|---|
| Gelatin, | 7.0 g/m$^2$ |
| Ascorbyl palmitate, | 5.0 g/m2 |

(A dispersion of ascorbyl palmitate was prepared by ballmilling for 16 hours 20 g of ascorbyl palmitate with 180 of 0.6% gelatin solution. To 160 g of this was added 2.5 ml of Dow-Corning Antifoam RD Emulsion then 160 g of 11.4% gelatin solution).

| Layer 2 | |
|---|---|
| Gelatin, | 3.3 g/m$^2$ |
| Polymer, | 1.1 g/m$^2$* |
| "Triton X100" surfactant, | 0.5 g/m$^2$ |
| Coupler (A), | 0.3 g/m$^2$ |
| Nickel sulphide nucleii, | 0.001 g/m$^2$** |
| Layer 3 | |
| Gelatin, | 3.3 g/m$^2$ |
| Polymer, | 1.1 g/m$^2$* |
| "Triton X100" surfactnt, | 0.5 g/m$^2$ |
| Hardener bis(vinylsulphonyl)methane, | 0.20 g/m$^2$ |

*copolymer (20:80) of acrylamide and sulpho-t-butylacrylamide.
**prepared by mixing aqueous sodium sulphide and nickel nitrate solutions into an aqueous gelatin solution.

The colour negative coating was exposed to a test pattern and developed for 2 minutes in Kodak C41 developer solution at a temperature of 42° C., then surplus developer solution squeegeed off and the coating laminated into face-to-face contact with a strip of receiver sheet which had been prepared by soaking for 2 minutes in water at 42° C. then for 2 minutes at 42° C. in the following solution:

| | g/l |
|---|---|
| sodium sulphite | 4.0 |
| glycine (aminoacetic acid) | 180.0 |
| sodium hydroxide | 80.0 |
| sodium thiosulphate pentahydrate | 60.0 |
| 4-hydroxymethyl-4-methyl-1-phenyl-3-pyrazolidone | 0.4 |

The laminate was held for 7 minutes at 45° C. under pressure from a vacuum blanket, then peeled apart. It was seen that the previously opaque coating had become clear and transparent through the lamination process, revealing a negative image of the test pattern. The degree of transparency was adequate for use of the negative in a printer or enlarger. Analysis of residual silver in the negative showed it had been reduced to 0.47 g/m$^2$ from a measured starting value of 3.6 g/m$^2$. The receiver sheet had become a dense brown colour from the silver metal which had been reduced in it. There was also some cyan colour believed due to coupling of colour developing agent carried over from the development stage.

The compounds referred to above had the following structural formulae:

Coupler (A):

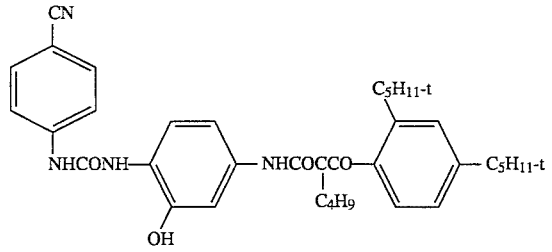

EXAMPLE 2

The colour negative coating of Example 1 was also used in this example.

A receiver or fixer sheet was prepared by coating the following composition on cellulose triacetate photographic film base:

| Layer 1 | |
|---|---|
| Gelatin, | 10 g/m$^2$ |
| 2,5-dioctylhydroquinone | 5.4 g/m$^2$ |
| nickel sulphide nuclei | 0.002 g/m$^2$ |
| bis(vinylsulphonyl)methane | 0.06 g/m$^2$ |

The dioctylhydroquinone was incorporated as a conventional dispersion, 1:3 with di-n-butylphthalate as oil phase solvent.

| Layer 2 | |
|---|---|
| as layer 1. | |
| Layer 3 | |
| Gelatin, | 2.0 g/m$^2$ |

The colour negative coating was exposed and developed as in Example 1, then bleached for 2 minutes at 38° C. in the bleach solution of the Kodak C41 process and washed for 1 minute in water. Surplus water was squeegeed off and the coating was laminated in face-to-face contact with the receiver sheet of this example, which had been soaked in water then alkaline fixer solution as in Example 1, and the laminate kept in contact under a vacuum blanket for 7 minutes at 45° C. On peeling apart, it was seen that the negative coating had essentially cleared (although a little less clear than in Example 1) to reveal a negative dye image of the test pattern. Residual silver in a Dmin area was determined by X-ray fluorescence to be 0.95 g/m$^2$.

EXAMPLE 3

This example illustrates the beneficial action of the incorporated reducing agent in the receiver sheet, even when a reducing or developing agent is present in the processing solution.

A colour negative coating similar to that of Example 1 was used.

Two receiver layers were prepared by coating the following compositions on cellulose acetate photographic film base:

| Coating A (Control) | |
|---|---|
| Gelatin | 10 g/m2 |
| nickel sulphide nuclei | 0.003 g/m2 |
| bis(vinylsulphonyl)methane | 0.09 g/m2 |
| Coating B (Invention) | |
| Gelatin, | 10 g/m2 |
| 2,5-dioctylhydroquinone, | 4.0 g/m2 |
| nickel sulphide nucleii, | 0.003 g/m2 |
| hardener bis(vinylsulphonyl)methane, | 0.09 g/m2 |

A developer-fixer solution was used; it had the following composition:

0.5% w/v carboxymethylcellulose sodium salt solution in water, 160 g (the compound, which was added to increase the viscosity of the developer-fixer, was obtained from the Aldrich Chemical Company, Inc.)

| | |
|---|---|
| sodium sulphite | 4 g |
| sodium thiosulphate pentahydrate | 54 g |
| ammonium thiosulphate | 6.6 g |
| CD4 colour developing agent | 15 g |
| glycine | 100 g |
| sodium hydroxide | 44.4 g |
| sodium carbonate | 40 g |
| water to | 1 litre |

The pH of the solution was 10.7 at 25° C.

A strip of unexposed negative film was soaked, together with a strip of receiver film, in the developer-fixer solution for 15 seconds at a temperature of 45° C., under darkroom conditions. The strips were withdrawn, in face to face contact, through a squeegee and the laminate was held for 7 minutes at 45° C. under pressure from a vacuum blanket, then the laminate was peeled apart, washed in running water, and the negative film dried and examined.

The film which had been laminated to the control or comparative receiver sheet A had darkened substantially and had not fixed or cleared at all. The diffuse transmission densities of the processed film were 3.18, 3.37, and 2.20 through red, green and blue Status M filters respectively. The film which had been laminated to the receiver sheet B of the invention had also darkened, but had also substantially cleared or become transparent, with corresponding densities of 1.51, 1.36, and 1.25 respectively. For comparison, the untreated film was opaque with corresponding densities of 0.91, 1.21, and 2.00 (the high blue density being partly due to the undischarged yellow filter dye). So the unexposed negative film had undergone a degree of fogging development in both cases, but had only become fixed when laminated to the receiving sheet containing the coated reducing agent.

EXAMPLE 4

This example demonstrates that particularly good results may be obtained when alkali metal salts of amino acids are used as the alkaline buffer, rather than an alkali metal carbonate such as sodium carbonate.

The experiments were conducted as in Example 1, but in this case the multilayer colour negative film was not developed before fixing: the solutions having similar compositions of thiosulphate salts, but differing in alkaline buffering agent, were used. The clarity of the fixed film was compared by means of its diffuse transmission density through a status M green filter, a clearer film sample having a lower density.

All solutions contained:

| | |
|---|---|
| sodium sulphite | 4.0 g/l |
| sodium thiosulphate pentahydrate | 54.0 |
| ammonium thiosulphate | 6.6 |

Base was added as follows, and the solutions were found to have the stated pH at 25° C.:

| | | | |
|---|---|---|---|
| Solution C1: | sodium carbonate | 0.30 molar | pH 10.36 |
| Solution C2: | sodium carbonate | 0.40 | pH 10.46 |
| Solution C3: | sodium carbonate | 0.50 | pH 10.51 |
| Solution C4: | sodium carbonate | 0.66 | pH 10.57 |
| Solution AA1: | glycine | 0.60 | |
| | sodium hydroxide | 0.50 | pH 10.30 |
| Solution AA2: | lysine hydrochloride | 0.60 | |
| | sodium hydroxide | 1.00 | pH 11.13 |

Portions of untreated film as described in Example 1 were fixed by soaking the film and the receiver sheet described in Example 1 in fixer solution at 40° C. for 15 seconds, and then laminating the two sheets in face-to-face contact and maintaining them at 40° C. for 7.5 minutes under pressure from a vacuum blanket. The two sheets were peeled apart, washed and dried, and the green status M density of the multilayer film measured in six places and averaged. The average densities were found to be:

| Density | Solution Green |
|---|---|
| C1 | 0.327 |
| C2 | 0.291 |
| C3 | 0.299 |
| C4 | 0.465 |
| AA1 | 0.268 |
| AA2 | 0.198 |

Thus the optimum concentration for the carbonate buffer was that of solution C2, which had substantially cleared the film. However the solutions using the sodium salt of glycine (AA1), and especially the sodium salt of lysine (AA2), gave improved clearing of the film.

EXAMPLE 5

The colour negative film of Example 1 was used in this example.

A comparison receiver sheet was prepared exactly as described in Example 2, except that the incorporated reducing agent (2,5-dioctylhydroquinone) was omitted, so that the coating comprised hardened gelatin at 23 g/m$^2$ containing 0.004 g/m$^2$ nickel sulphide nuclei.

The colour negative coating was was exposed, developed, bleached and washed as in Example 2. Surplus water was squeegeed off and the coating was laminated in face to face contact with the receiver sheet of this example, which had been soaked in water then alkaline fixer solution as in Example 1, and the laminate kept in contact under a vacuum blanked for 7 minutes at 45° C. On peeling apart, it was found that the negative coating remained opaque, and had not cleared. The receiver sheet remain clear and apparently unchanged, whereas when the experiment was conducted using the receiver sheet according to the invention in Example 2, the negative coating had cleared and the receiver sheet had developed an opaque yellow-brown deposit of silver.

The amounts of silver in areas corresponding to minimum developed density in the negative were measured, by X-ray fluorescence, for the negative film and the receiver sheet in each case. The results were:

| | Silver in g/m$^2$ by x-ray fluorescence | |
|---|---|---|
| | Example 2 (Invention) | Comparison |
| Negative film | 0.90 | 2.80 |
| Receiver sheet | 2.62 | 0.19 |

It can be seen that, in the case of the invention most of the silver had moved to the receiver sheet while in the comparative case in which the fixer sheet only contained silver precipitation nuclei, most had remained in the negative film.

EXAMPLE 6

The colour film of Example 1 is again used in this Example.

A fixer or receiver coating was prepared by coating the following layers in order on cellulose triacetate photographic film base:

| Layer 1 | |
|---|---|
| Gelatin, | 3.3 g/m$^2$ |
| Aluminum flakes, | 1.0 g/m$^2$ |

(The aluminium used was a sample of water-dispersible aluminium pigment supplied by Wostenholme Bronze Powders Limited, of Darwen, Lancashire. It was received as a paste which was mechanically dispersed by a rotor-stator device into aqueous gelatin solution.)

| Layer 2 | |
|---|---|
| Gelatin, | 2.0 g/m$^2$ |
| Polymer, | 1.25 g/m$^2$* |
| "Triton X100" surfactant, | 0.5 g/m$^2$ |
| Hardener bis(vinylsulphonyl)methane, | 0.08 g/m$^2$ |

*a copolymer (20:80) of acrylamide and sulpho-t-butylacrylamide.

The colour negative coating was exposed to a test pattern and developed for 2 minutes in Kodak C41 developer solution at a temperature of 42° C., then surplus developer solution squeegeed off and the coating laminated into face-to-face contact with a strip of receiver sheet which had been prepared by soaking for 2 minutes in water at 42° C. then for 2 minutes at 42° C. in the following solution:

| | g/l |
|---|---|
| sodium sulphite | 4.0 |
| glycine (aminoacetic acid) | 180.0 |
| sodium hydroxide | 80.0 |
| sodium thiosulphate pentahydrate | 60.0 |
| 4-hydroxymethyl-4-methyl--1-phenyl-3-pyrazolidone) | 0.4 |

The laminate was held for 7 minutes at 45° C. under pressure from a vacuum blanket, then peeled apart. It was seen that the previously opaque coating had become clear and transparent through the lamination process, revealing a negative image of the test pattern. The degree of transparency was adequate for use of the negative in a printer or enlarger. The aluminium-containing fixer sheet, originally silver in appearance, had become a dull grey in the areas where it was laminated to the colour negative film.

EXAMPLE 7

The colour negative coating and the fixer sheet coating of Example 1 were also used in this example.

The colour negative coating was exposed and developed as in Example 6, then bleached for 2 minutes at 38° C. in the bleach solution of the Kodak C41 process and washed for 1 minute in water. Surplus water was squeegeed off and the coating was laminated in face-to-face contact with the receiver sheet, which had been soaked in water then alkaline fixer solution as in Example 6, and the laminate kept in contact under a vacuum blanket for 7 minutes at 45° C. On peeling apart, it was seen that the negative coating had essentially cleared to reveal a negative dye image of the test pattern. The fixer sheet had again darkened in the areas which had been laminated to the colour negative film.

I claim:

1. A method of fixing a developed photographic silver halide material comprising at least two silver halide layers sensitized to different regions of the spectrum and having one or more undeveloped areas, comprising:

providing a fixer sheet which comprises reducing means capable of forming metallic silver in said fixer sheet from solubilized silver halide, said reducing means comprising particles of a metal more electropositive than silver dispersed in said fixer sheet, and placing said photographic material in face-to-face contact with said fixer sheet in the presence of a processing solution and a silver halide solvent capable of forming a solubilized silver halide species from the undeveloped areas of the material, whereby metallic silver is formed in said fixer sheet.

2. A method as claimed in claim 1, wherein said photographic material is a color negative film.

3. A method as claimed in claim 1, wherein the processing solution is alkaline.

4. A method as claimed in claim 3, wherein the processing solution has a pH of from about 9 to about 13.

5. A method as claimed in claim 3, wherein the processing solution contains the salt of an amino acid.

6. A method as claimed in claim 1, wherein said metal is magnesium, zinc, or aluminum.

7. A method as claimed in claim 6, wherein said metal is aluminum.

8. A method as claimed in claim 1, wherein said fixer sheet further comprises a means for immobilizing oxidized color developing agent.

9. A method as claimed in claim 8, wherein said means for immobilizing comprises a coupler compound.

10. A method as claimed in claim 1, wherein said fixer sheet further comprises silver precipitating nuclei.

* * * * *